United States Patent [19]

Ruf et al.

[11] 4,432,380

[45] Feb. 21, 1984

[54] APPARATUS FOR REMOVING OPTICAL COMPONENT BLANKS FROM A BLOCKING TOOL

[75] Inventors: Hans R. Ruf, Illnau; Rolf Quattländer, Effretikon; Max Reichlin, Illnau; Patrik Hilpert, Volketswil, all of Switzerland

[73] Assignee: Roag, Illnau, Switzerland

[21] Appl. No.: 376,003

[22] Filed: May 7, 1982

[30] Foreign Application Priority Data

Jun. 24, 1981 [CH] Switzerland ..... 4186/81

[51] Int. Cl.[3] ..... B08B 3/12

[52] U.S. Cl. ..... 134/104; 134/105; 134/184

[58] Field of Search ..... 134/1, 104, 105, 184

[56] References Cited

U.S. PATENT DOCUMENTS

| | | | |
|---|---|---|---|
| 3,405,916 | 10/1968 | Carmichael | 134/184 X |
| 3,795,358 | 3/1974 | Sarnacki et al. | 134/1 X |
| 4,064,885 | 12/1977 | Dussault et al. | 134/184 X |
| 4,187,868 | 2/1980 | Rudolphi | 134/1 X |

FOREIGN PATENT DOCUMENTS

| | | | |
|---|---|---|---|
| 626842 | 9/1978 | U.S.S.R. | 134/184 |

*Primary Examiner*—Robert L. Bleutge
*Attorney, Agent, or Firm*—Warren B. Kice

[57] ABSTRACT

Optical lenses mounted by means of a low melting alloy to blocking tools are separated therefrom under influence of heated water and ultrasonic waves and residues of the alloy are removed from the lenses and the blocking tools. The lenses are held in a holding device and the blocking tools are collected in a grid; the mounting material is collected in a sump such that the lenses and blocking tools can be separately removed out of the water. The water and the mounting alloy kept in a liquid state of aggregate are discharged batchwise.

8 Claims, 3 Drawing Figures

APPARATUS FOR REMOVING OPTICAL COMPONENT BLANKS FROM A BLOCKING TOOL

BACKGROUND OF THE INVENTION

1. Field of the Invention

The present invention relates to an improved method of removing optical components from a blocking tool, which optical components are mounted thereto by means of a low melting alloy, in which said optical components are placed together with their respective blocking tools in a heated liquid bath, in which bath said optical components and their blocking tools are exposed to ultrasonic vibrations in order to deblock said optical components from their respective blocking tools and to remove any mounting material adhering to said optical components and their blocking tools whereupon said optical components, said blocking tools and said mounting material are collected separately.

The present invention relates further to an improved apparatus for removing optical components from a blocking tool, which optical components are mounted thereto by means of a low melting alloy, which apparatus comprises a heated liquid bath and a source of ultrasonic vibrations intended for a deblocking of said optical components from their respective blocking tools and for removing any mounting material from said optical components and blocking tools and comprises further means for separately collecting said optical components, said blocking tools and said removed mounting material, which said apparatus is provided with a tank provided with a heating means; a plurality of ultrasonic transducers mounted to the floor of said tank; a means for holding said optical components which are placed into said tank and a collecting grid intended for collecting deblocked blocking tools.

Before an optical component, for instance, a completely finished and polished lens can be further handled in a cleaning apparatus, such optical component must be deblocked, it must be removed from the blocking tool onto which it has been mounted for allowing above mentioned treatment. This so-called deblocking has hitherto been done manually in that a rim or edge, respectively, area of such optical component projecting beyond its blocking tool is struck against a projection, for instance, the edge of a table, in order to detach the optical component from its blocking tool by such impact treatment. Thereafter, the optical components are cleaned in a cleaning apparatus by the agency of ultrasonic waves and the blocking tools are manually cleaned in a water bath by the agency of a brush. The mounting mass, i.e. the material with which the optical components are mounted, adhered to the blocking tool is collected separately.

Such operation is, however, disadvantageous because the scrap-to-finished product ratio of the optical components is rather high and because the losses of mounting material are extremely high, and the expenditure on work is relatively large.

2. Description of the Prior Art

In the publication "An ultrasonic apparatus for removing optical component blanks from the blocking tool" written by V. G. Zubakov, V. V. Vdovknia, published by the American Institute of Physics, New York, a method for removing optical component blanks from the blocking tool is described, according to which a plurality of optical component blanks which are commonly or separately mounted to a single block are separated and removed from the block or the blocks, respectively, in a tank in which ultrasonic means are located. The removed optical components are collected by a grid. In order to transmit the ultrasonic energy an alcohol-benzene and water-alkali mixtures were used as the work medium in the tank. Thereby a polishing pitch was used as the cementing material. The blocking tools (blocks) consisted of a plastic material. The oscillating means were piezoceramic transducers powered by oscillators which were mounted on the bottom and the walls of the tank. The operating frequency of the transducers was ~18 kHz.

The method and apparatus disclosed are, however, disadvantageous because a specific solution or mixture, respectively, is utilized as means of transport for the ultrasonic energy and further that the blocking tools which are initially inserted into the tank maintain their position whereby, however, the optical components fall down onto a grid such that they can suffer scratches, and a further disadvantage is that the removed mounting material must be removed from the tank by a separate operating step.

SUMMARY OF THE INVENTION

Hence, it is a general object of the present invention to provide an improved apparatus for removing optical components from a blocking tool which does not suffer above outlined drawbacks.

A further object is to provide an improved apparatus comprising a sump located at the bottom of a tank, which sump is provided with a discharging means for collecting and discharging any removed mounting material; which apparatus comprises further a second heating means arranged at the sump and the discharging means and intended to keep removed mounting material in a liquid state of aggregate; which apparatus comprises further a supporting rack whereby the collecting grid is a section of the supporting rack, which supporting rack is arranged to receive the holding means for the optical components and the blocking tools; and which apparatus comprises a means for moving the optical components including the locking tools relative to the ultrasonic transducers and arranged to be suspended at the supporting rack.

According to a preferred embodiment the holding means for the optical components comprises at least one pair of cross bars extending parallel to each other and intended for supporting the optical components, which holding means comprise further a plurality of devices for holding down the optical components, of which devices each is individually engageable into said optical components such to lock said optical components to said parallel cross bars.

The DE-C-379 803 discloses a holding device which is provided with a riveted frame, into which the lenses or optical components, respectively, are placed and which frame comprises a pivotable bracket which holds the optical components.

Such holding means has, however, the drawback that only optical components such as lenses can be introduced into the holding device which have the same diameter as well as the same shape.

In contrast thereto, the apparatus according to the present invention is advantageously improved in that it is possible to insert and accordingly handle lenses of varying size and shape such that this apparatus can economically be used also in smaller laboratories.

This proves to be true specifically, if the holding down member or means, respectively, comprises leg springs which can abut or engage into the circumference of the optical components.

Preferably, the discharge member is of a T-shaped construction and the second heating member is advantageously a heater insert which is located into the rectilinearly extending section of the T-shaped discharge member whereby a shut-off valve is arranged in the branched off part of the discharge member, whereby the tank is provided furthermore with a discharging stub including a shut-off valve which opens into an area above the sump.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings, wherein.

DETAILED DESCRIPTION OF THE PREFERRED EMBODIMENTS

Figure 1:
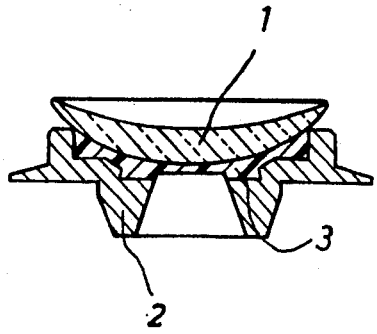
FIG. 1 is a view of a section of an optical component mounted to a blocking tool, which two parts are to be removed from each other.

Describing now the drawings, and considering initially FIG. 1, it will be understood that there is shown in section an optical component 1, for instance, a polished lens together with a mounting body 2, i.e. a blocking tool, which two members are mounted or cemented, respectively, to each other by means of a cementing mass 3. This cementing mass 3 is an alloy having a low melting point.

The mounting of the raw lens, i.e. the blank, onto the blocking tool 2 is carried out by means of the well-known blocking machines whereby an alloy in its liquid state is poured into the intervening space between the raw lens and the blocking tool. After setting of the alloy the lens and the blocking tool 2 form together a unit which can be mounted into a suitable machining apparatus, such as polishing apparatus.

The dismounting or deblocking, respectively, of the polished lens 1 from the blocking tool 2 is carried out in the apparatus described below, which apparatus may be part of a cleaning machine.

Figure 2:
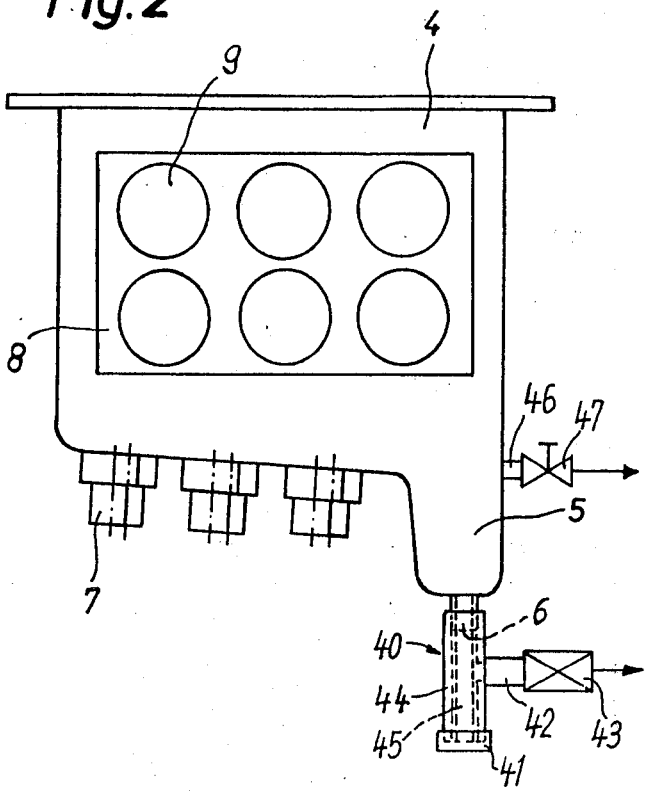
FIG. 2. is a side view of a tank in which optical components are removed from blocking tools.

Referring now to FIG. 2, there is shown therein an apparatus comprising a substantially rectangular tank 4. A sump 5 is arranged on a narrow side area of the tank 4, which sump 5 collects any removed cementing mass. A nipple 6 is welded into the sump 5. The bottom floor of the tank 4 is slanted in direction to sump 5, such to lead any removed cementing mass into sump 5. Six ultrasonic transducers 7 are located in the bottom of the tank, which ultrasonic transducers 7 are arranged in two parallel rows having each three transducers, whereby the transducers of one row are offset somewhat to the transducers of the other row. These ultrasonic transducers 7 are of a well-known design and are operated by a not particularly shown control apparatus. The output frequency of the ultrasonic transducers 7 amounts to more than 20 kHz. The HF-output and the quantity of ultrasonic transducers depends on the extent of the circumference of the bath and on the number of lenses which are to be deblocked in the bath and amounts to about 100–1200 watts. The apparatus is provided, furthermore, with a not particularly shown means with which the optical components are moved relative to the source of ultrasonic waves.

The tank 4 is provided with at least one heating means 8, which is mounted to the outer side of one of the longitudinal walls of the tank 4. This heating means 8 comprises a number of heating plates 9, similar to the heating plates of an electric range for domestic use, which abut directly the side wall of tank 4. Furthermore, a safety switch element (not particularly shown) is mounted to the tank 4 such to prevent an overheating of an empty tank 4.

A T-shaped pipe section 40 is screwed at the one end onto nipple 6, which pipe section 40 is closed at the other end by means of a cap 41. The branch of section 42 of this pipe section 40 is mounted to a shut-off valve 43, through which shut-off valve 43 the cementing mass in its liquid state is intermittently or batchwise, respectively, discharged.

A second heating means 45 having the form of a heating insert is arranged in the passageway 44 of pipe section 40, which heating means 45 is held at the one end by cap 41 and is aligned at the other end with the bottom of sump 5.

Immediately above sump 5 a nipple 46 is welded into the corresponding side wall of the tank 4, onto which nipple 46 a shut-off valve 47 is threaded.

Figure 3:
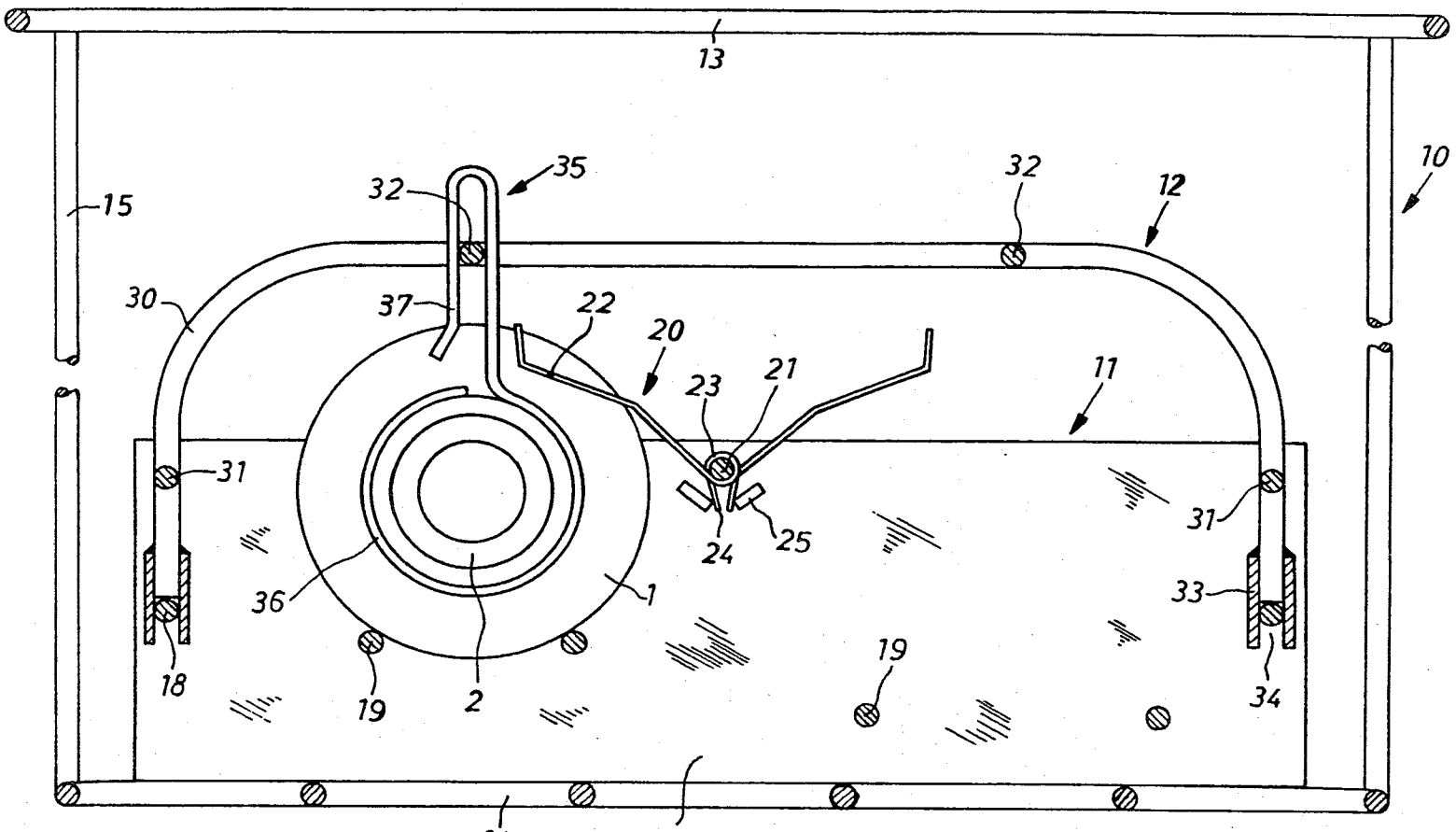
FIG. 3 is a view of a section of a holding means for the optical components and the blocking tools, which holding means are insertable into the tank.

Reverting now to FIG. 3, there is shown a supporting rack 10, in which a means 11 for holding the lenses 1 and a second means 12 for holding the blocking tools 2 are arranged. The supporting rack 10 features the shape of a basket, which can be inserted into the tank 4 and consists of an upper, rectangular frame 13 and a rectangular grid element 14, which are mounted to each other by means of four vertically extending bars 15. The two holding means 11, 12 are supported by mentioned grid. The upper frame 13 is provided with not particularly shown means, with which the supporting rack 10 may be mounted to a device which moves the optical elements relative to the source 7 of ultrasonic waves.

The means 11 which is intended to hold the lenses 1 defines a bottom part and the second means 12 intended for holding the blocking tools forms an upper part of a structure which can be inserted into the supporting rack 10.

The lower part 11 is provided with two face walls 17 made of sheet metal, two struts 18, which are mounted to the face walls 17 and two pairs parallel extending cross bars 19 which are mounted to the face walls 17, too, and are intended each for supporting the lenses 1. Furthermore, the lower part 11 is provided with devices 20 for lenses 1, which are mounted onto a mounting bar 21. The cross bars 19 extend wavelike into the longitudinal direction thereof, whereby a wave trough each is intended as supporting area for a lens 1.

The holding down device 20 is a U-shaped bent member, of which the base section can be brought to abut the circumference of lens 1 and having legs 22 which define each a leg of a leg spring, of which the winding 23 is located on the mounting bar 21 and the other leg 24 abuts a flat strip 25. This flat strip 25 is part of a not particularly shown means with which the holding down device 20 is brought into engagement or is disengaged.

The upper part 12 comprises two elongated brackets or frame parts, respectively, 30 extending on its narrow side, comprises two struts 31 as well as two supporting bars 32 for the blocking tools 2, which are mounted together with the frame parts 30 to a main frame. A sleeve 33 each is mounted to the ends of the frame parts 30, which sleeves 33 are each provided with a slit 34, such to allow the setting of the upper part 12 onto the struts 18 of the lower part 11.

In order to keep the blocking tool 2 attached or mounted, respectively, to the supporting bar 32, a mounting member 35 is provided. This mounting member 35 comprises a metal strip, which is shaped at the one end as an open, circular eyelet 36, into which the blocking tool 2 can be inserted and is shaped at the other end as hook 37 which may be hooked onto the supporting bar 32.

In case of this embodiment of the supporting rack 10 the upper part 12 and the mounting member 35 for the blocking tools 2 may be omitted.

The operation of the apparatus for separating the lenses from their blocking tools is divided in a preparation step and a separating step.

In the preparation step the tank is filled with water and thereafter the heating means 8; 45 are switched on in order to heat the water to a temperature in the range of about 140° F.–175° F. Within a time span ranging from 16 to 20 minutes before the water has reached its operating temperature, the ultrasonic transducers are energized in order to degas the water.

At the same time the lenses including the blocking tools 2 are arranged on the cross bars 19 of the lower part 11 and arrested by engagement by the holding down device 20. Thereafter, the upper part 12 can be mounted onto the lower part 11 and the blocking tools 2 inserted into the eyelet 36 of the mounting members 35 which are hooked into or onto, respectively, the supporting bars 32 by means of their hooks 37. Thereafter, the lower part 11 is inserted into the carrying rack or frame, respectively. Accordingly, the preparation step is accomplished.

If the means 12 for holding or supporting, respectively, the blocking tools 2 is used, the upper part 11 is mounted together with the lower part 12 into the supporting rack 10.

At the following removing step the supporting rack 10 is hooked into the means which is intended for moving the optical component relative to the ultrasonic transducers 7 and the supporting rack 10 comprising now the lenses 1 and the blocking tools 2 is moved relatively to these ultrasonic transducers 7 which have been put into operation, i.e., the supporting rack 10 carries out continuously an up- and down-movement along a distance in the range of 1 ½–3 ¼inches (3–8 cm). The alloy having a low melting point which is used as the cementing mass 3 will become liquid due to the heated water. The blocking tools 2 fall under the influence of their own gravity downwards and are collected by the grid 19 and the lenses 1 will be kept by the down holders 20 at the cross bars 19 in the lower part 12. This will avoid a possible swimming upwards of the lenses 1. If the means 12 for holding the blocking tools 2 is used, the loosened blocking tools fall also downwards and will be held by the mounting members 35.

Simultaneously with the removing of the blocking tools 2 from the lenses 1 any possible residual cementing mass 3 adhering thereupon is removed by the influence of the ultrasonic waves. This cementing mass 3 falls downwards onto the bottom of the tank and is collected in the sump 5 of tank 4 and is kept in a fluid state by means of the heating device 45 arranged in the T-shaped pipe section 40.

After the termination of the separating or removing, respectively, phase the supporting rack 10 is lifted out of the tank 4. Its lower part 11 comprises only the polished lenses 1. These polished lenses 1 may now be made subject to a further cleaning action without the necessity of touching the lenses or manually handling the lenses which is a considerable advantage.

Because in this embodiment the blocking tools 2 are not held specifically, they fall after getting detached from the lens 1 onto the grid 14 of the supporting rack 10. After removing the supporting rack 10 out of the tank 4, the lower part 11 can be extracted together with the lenses 10 out of the supporting rack 10. Thereafter, the blocking tools 2 can be collected and due to the degree of cleaning they have been subjected to they can be again blocked without any further handling, i.e. they may again be cemented to further blank lenses to be polished. If the second holding means is used, the blocking tools can be lifted off together with the upper part 12 and be dismounted from the mounting members 35 such that, as mentioned above, they also are ready for further use.

According to the above description it is obvious, that the separation of the lenses 1 from the blocking tools 2 proceeds quite gently and simultaneously the two elements are cleaned.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An improved apparatus for removing optical components from a blocking tool, which optical components are mounted thereto by means of a low melting alloy, which said apparatus comprises a heated liquid bath and a source of ultrasonic vibrations intended for deblocking said optical components from their respective blocking tools and for removing any mounting material from said optical components and blocking tools and comprises further means for separately collecting said optical components, said blocking tools and said removed mounting material, which said apparatus is provided with a tank provided with a heating means; a plurality of ultrasonic transducers mounted to the floor of said tank; a means for holding said optical components, which are placed into said tank and a collecting grid intended for collecting deblocked blocking tools;

the improvement comprising a sump located at the bottom of said tank, which said sump is provided with a discharging means for collecting and discharging any removed mounting material; comprising further a second heating means arranged at said sump and said discharging means and intended to keep removed mounting material in a liquid state of aggregate; comprising further a supporting rack, whereby said collecting grid is a section of said supporting rack, which said supporting rack is arranged to receive said holding means for said optical components and said blocking tools; and comprising a further means for moving said optical components including said blocking tools relative to said ultrasonic transducers and arranged to be suspended at said supporting rack.

2. The apparatus of claim 1, wherein said holding means for said optical components comprises at least one pair of cross bars extending parallel to each other and intended for supporting said optical components and comprises further a plurality of devices for holding down said optical components, of which devices each is individually engageable into said optical components such to lock said optical components to said parallel cross bars.

3. The apparatus of claim 1, wherein said holding down devices comprise leg springs intended to engage into the circumference of said optical components.

4. The apparatus of claim 1, wherein said discharging means is a T-shaped member and said second heating device is a heating insert located in the rectilinear section of said T-shaped discharging means, and wherein there is provided a blocking valve arranged in the branched-off section of said T-shaped discharging means.

5. The apparatus of claim 1, wherein said tank is provided further with a discharging stub including a shut-off valve, which said discharge stub opens into an area above said sump.

6. The apparatus of claim 1, wherein there is provided a second holding means allocated to said blocking tools, which said second holding means is arranged to be set upon the first-named optical components holding means.

7. The apparatus of claim 6, wherein said second holding means comprises two supporting bars for said blocking tools and means for guiding said second holding means relative to said first-named holding means.

8. The apparatus of claim 7, comprising mounting members for said blocking tools, which said mounting members are arranged at the one hand to be clamped onto a blocking tool and at the other hand to be locked into one of said supporting bars.

* * * * *